US005232340A

United States Patent [19]

Morgan

[11] Patent Number: 5,232,340

[45] Date of Patent: Aug. 3, 1993

[54] GAS TURBINE ENGINE STATOR ASSEMBLY

[75] Inventor: Clive A. Morgan, Stapleford, England

[73] Assignee: General Electric Company, Cincinnati, Ohio

[21] Appl. No.: 952,384

[22] Filed: Sep. 28, 1992

[51] Int. Cl.[5] ..... F01D 9/00

[52] U.S. Cl. ..... 415/190; 415/209.2; 415/209.4

[58] Field of Search ..... 415/189, 190, 209.1, 415/209.2, 209.3, 209.4, 210.1

[56] References Cited

U.S. PATENT DOCUMENTS

| | | | |
|---|---|---|---|
| 2,834,537 | 5/1958 | Neary . | |
| 2,945,290 | 7/1960 | Walsh . | |
| 3,365,173 | 1/1968 | Lynch et al. | 415/209.2 |
| 3,938,906 | 2/1976 | Michel et al. | 415/139 |
| 4,142,827 | 3/1979 | Vinciguerra . | |
| 4,425,078 | 1/1984 | Robbins . | |
| 4,659,289 | 4/1987 | Kalogeros | 415/173.7 |
| 4,687,413 | 8/1987 | Prario | 415/190 |
| 4,856,963 | 8/1989 | Klapproth et al. | 415/190 |
| 5,127,793 | 7/1992 | Walker et al. | 415/209.2 |

FOREIGN PATENT DOCUMENTS

| | | | |
|---|---|---|---|
| 1252179 | 12/1960 | France | 415/209.3 |
| 2019954 | 11/1979 | United Kingdom . | |

*Primary Examiner*—Edward K. Look
*Assistant Examiner*—Michael S. Lee
*Attorney, Agent, or Firm*—Jerome C. Squillaro

[57] ABSTRACT

A gas turbine engine stator assembly includes an annular casing, a stator nozzle segment, and a shroud joined therewith. The nozzle segment includes an outer band having a forward hook joined to a complementary forward hook extending from the casing. The outer band also includes a plurality of circumferentially spaced apart stator lugs defining therebetween stator slots. The stator lugs are disposed between an aft flange and complementary lugs extending from the casing. Slots defined respectively between the stator and casing lugs are axially aligned for receiving axially extending lugs on the shroud for restraining rotation of the stator segment about the centerline axis of the casing.

7 Claims, 7 Drawing Sheets

GAS TURBINE ENGINE STATOR ASSEMBLY

The present invention relates generally to gas turbine engines, and, more specifically, to mounting a stator nozzle segment therein.

BACKGROUND OF THE INVENTION

A conventional gas turbine engine typically includes a low pressure, or power, turbine having alternating rows of stators and rotors. The stators, also referred to as stator nozzles, include a plurality of circumferentially spaced apart stator vanes which suitably direct combustion gases to the rotor stage immediately downstream therefrom. Each rotor stage includes a plurality of circumferentially spaced apart rotor blades which extract energy from the combustion gases for rotating the rotor and in turn providing output shaft power therefrom.

A single stator stage typically includes a plurality of circumferentially adjoining stator segments each with a plurality of circumferentially spaced apart vanes fixedly joined to radially outer and inner bands. When assembled together, the outer and inner bands collectively form rings with a full complement of vanes extending therebetween. The stator segments must be securely mounted to the turbine outer casing for reacting axial, tangential, and bending forces imposed against the stator vanes by the combustion gases being channeled therebetween. These gases impose an axially rearwardly directed force against the vanes which in turn creates bending force, or moment, about the outer band which supports the stator segment to the casing. Since the vanes are pitched for suitably turning the combustion gases in the downstream axial direction, tangential forces are also imposed on the vanes which tend to rotate the stator assembly about the longitudinal centerline axis of the turbine.

Conventional mounting arrangements for securing the stator stages to the turbine casing include complementary forward hooks on the casing and the stator outer band which join together for radially retaining the stator segments to the casing at their forward ends. And, at their aft ends, the outer bands typically include an annular flange which abuts either a complementary casing flange or retention strip for reacting aft directed axial forces into the turbine casing. Anti-rotation pins or dowels are typically used to prevent the stator segments from rotating about the turbine centerline axis relative to the turbine casing by reacting the tangentially directed gas loads. Since the stator inner band is itself not supported directly to an adjacent structure, the stator vanes and the inner band tend to bend or tilt in the aft direction relative to the casing since they are cantilevered relative to the outer band mounted to the casing. Accordingly, the stator forward hook is also configured for reacting the bending forces acting on the stator.

During assembly of the stator segments to the turbine casing, each of the stator segments is typically tilted forward for assembling the forward hook to the turbine casing and for clearing the rear flange of the outer band with its complementary mounting flange in the casing. Tilting, however, requires additional annulus space in the turbine and, therefore, the turbine requires increased axial clearance between stators and rotors.

Accordingly, efficiency losses are introduced due to the increased annulus required for allowing tilting during assembly. And, the assembly process itself is relatively complex by requiring tilting and additional parts such as the tangential retention dowels and the axial retention strips. Furthermore, the dowels are typically provided through holes in the casing which effect undesirable stress concentrations which must be accommodated for maintaining useful life of the turbine casing. And, increased cost is also associated with these stator segment retention assemblies.

SUMMARY OF THE INVENTION

A gas turbine engine stator assembly includes an annular casing, a stator nozzle segment, and a shroud joined therewith. The nozzle segment includes an outer band having a forward hook joined to a complementary forward hook extending from the casing. The outer band also includes a plurality of circumferentially spaced apart stator lugs defining therebetween stator slots. The stator lugs are disposed between an aft flange and complementary lugs extending from the casing. Slots defined respectively between the stator and casing lugs are axially aligned for receiving axially extending lugs on the shroud for restraining rotation of the stator segment about the centerline axis of the casing.

BRIEF DESCRIPTION OF THE DRAWINGS

The invention, in accordance with preferred and exemplary embodiments, together with further objects and advantages thereof, is more particularly described in the following detailed description taken in conjunction with the accompanying drawings in which.

DESCRIPTION OF THE PREFERRED EMBODIMENT(S)

Figure 1:
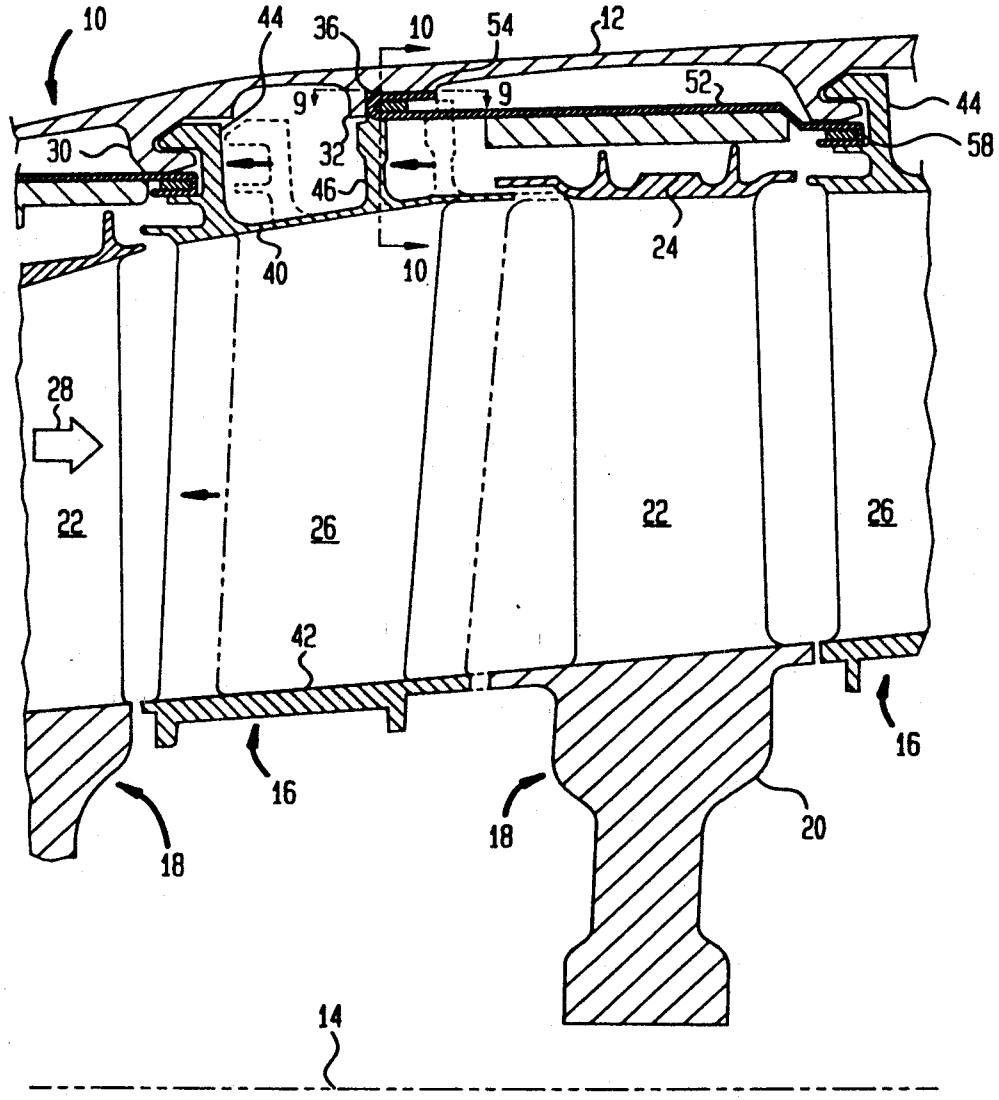
FIG. 1 is an axial, partly sectional view of a portion of a gas turbine engine low pressure turbine assembly having a stator nozzle joined to a casing in accordance with one embodiment of the present invention.

Illustrated schematically in FIG. 1 is an exemplary low pressure or power turbine 10 of a gas turbine engine for powering an aircraft, for example. The turbine 10 includes an annular turbine outer casing 12 having an axial centerline axis 14 in which are mounted exemplary stator nozzle and rotor stages 16, 18, respectively. Each rotor stage 18 includes a rotor disk 20 having a plurality of circumferentially spaced apart rotor blades 22 each having a sealing tip 24. Disposed upstream of each rotor stage 18 is a complementary stator stage 16 each also including a plurality of circumferentially spaced apart stator nozzle vanes 26. The nozzle vanes 26 receive combustion gases 28 generated in a combustor (not shown) which firstly flow through a high pressure turbine (not shown) and then to the low pressure turbine 10. The stator stages 16 direct the combustion gases 28 to the corresponding rotor stages 18 which extract energy therefrom for rotating the respective disks 20 about the centerline axis 14 for providing output shaft power from the rotor stages 18. The combustion gases 28 impose both a rearwardly directed force and a tangentially directed force on the vanes 26 which must be suitably carried by the casing 12.

Figure 2:
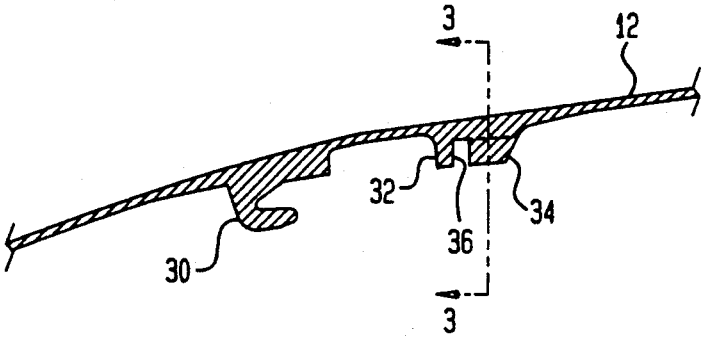
FIG. 2 is an axial sectional view of a portion of the turbine casing illustrated in FIG. 1.
Figure 3:
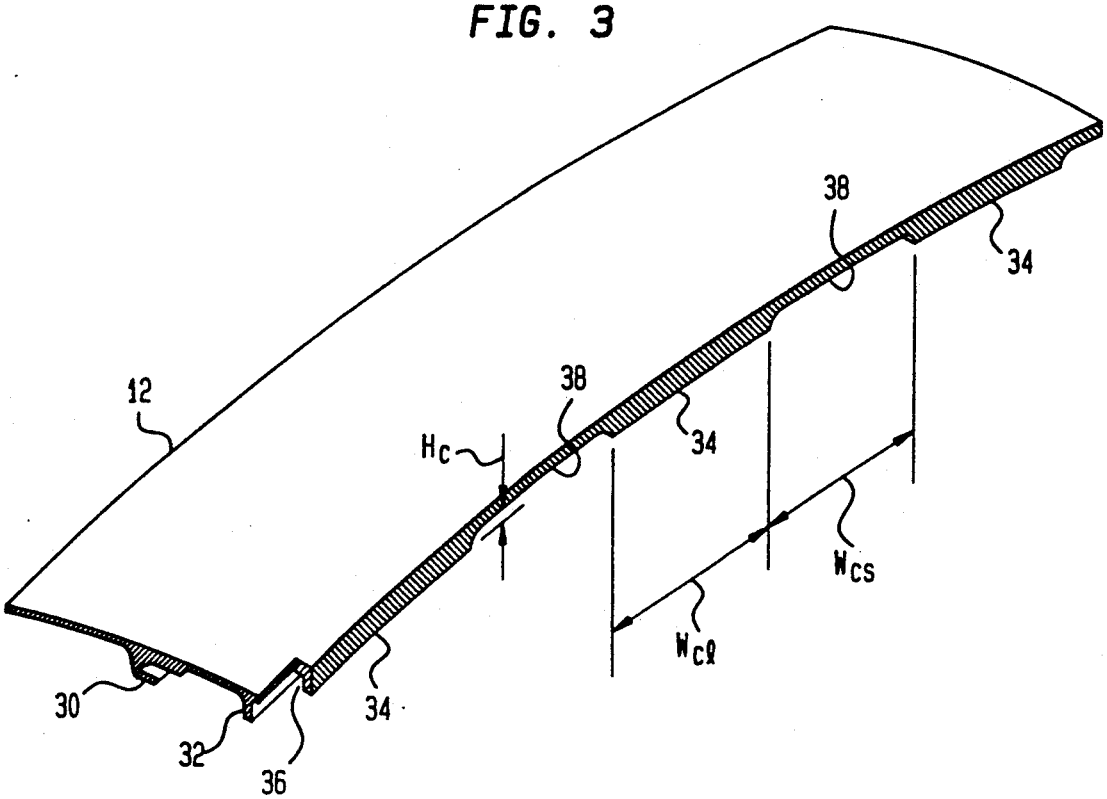
FIG. 3 is an isometric view of the turbine casing portion illustrated in FIG. 2 taken generally along line 3—3.

More specifically, the vanes 26 are mounted to the casing 12 as shown in FIG. 1 in accordance with one embodiment of the present invention to provide accurate positioning therein while reacting the axially and tangentially directed forces from the combustion gases 28. As shown in more particularity in FIGS. 2 and 3, the casing 12 includes a conventional, L-shaped annular forward hook 30 which faces in an axially aft direction. The casing 12 also includes an annular aft flange 32 spaced axially aft of the forward hook 30, and a plurality of circumferentially aligned casing aft lugs 34 spaced axially aft from the aft flange 32 to define an annular casing groove 36 therebetween. The casing forward hook, aft flange, and lugs 30, 32, 34 all extend radially inwardly from the casing 12 and coaxially about the centerline axis 14. As shown in FIG. 3, the casing lugs 34 are circumferentially spaced apart from each other to define arcuate casing slots 38 therebetween which face radially inwardly.

Figure 5:
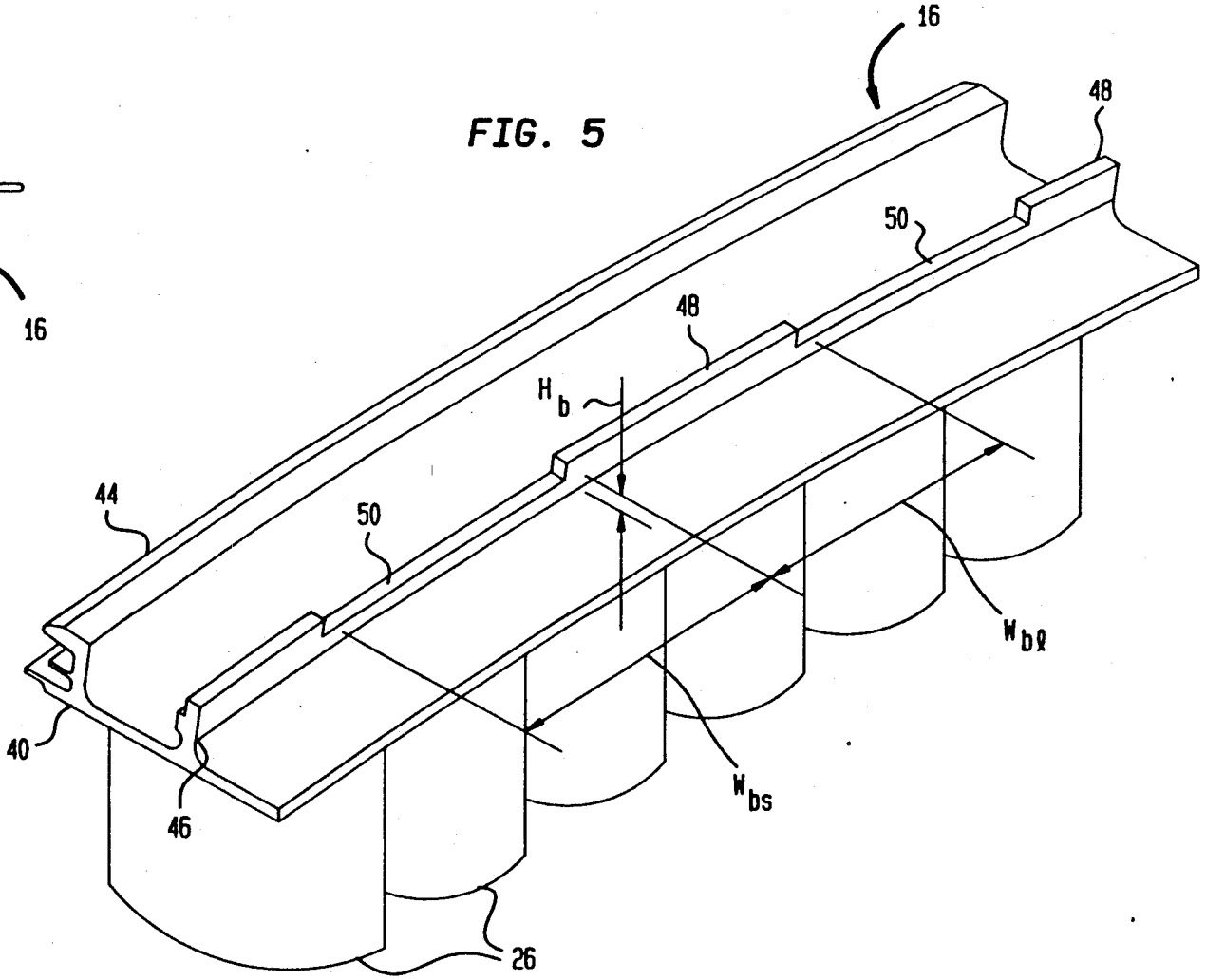
FIG. 5 is an isometric view of the stator nozzle segment portion illustrated in FIG. 4.
Figure 4:
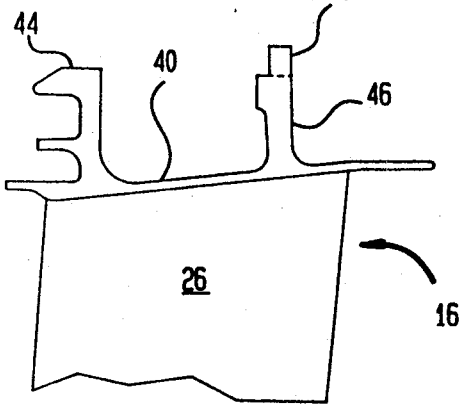
FIG. 4 is an axial view of a portion of the stator nozzle segment illustrated in FIG. 1.

FIGS. 4 and 5 show one embodiment of the stator nozzle stage 16 in the form of an arcuate stator nozzle segment having an arcuate radially outer band 40, and an arcuate radially inner band 42 (see FIG. 1) between which radially extend a plurality of circumferentially spaced apart nozzle vanes 26. In the exemplary embodiment illustrated in FIG. 5, six vanes 26 are provided in each stator nozzle segment 16, with a suitable plurality of the segments 16 adjoining each other circumferentially to form a complete 360° ring. The outer band 40 includes a conventional, radially outwardly extending forward hook 44 which has a generally U-shaped configuration and faces axially forward for being axially translatable into position onto the complementary casing forward hook 30 shown in FIG. 1 for being radially and axially supported thereby in a conventional fashion. The outer band 40 also includes a radially outwardly extending aft flange 46 which includes a plurality of circumferentially spaced apart stator lugs 48 extending radially outwardly from the aft flange 46. Adjacent ones of the stator lugs 48 define therebetween arcuate stator slots 50 which also face radially outwardly.

Figure 7:
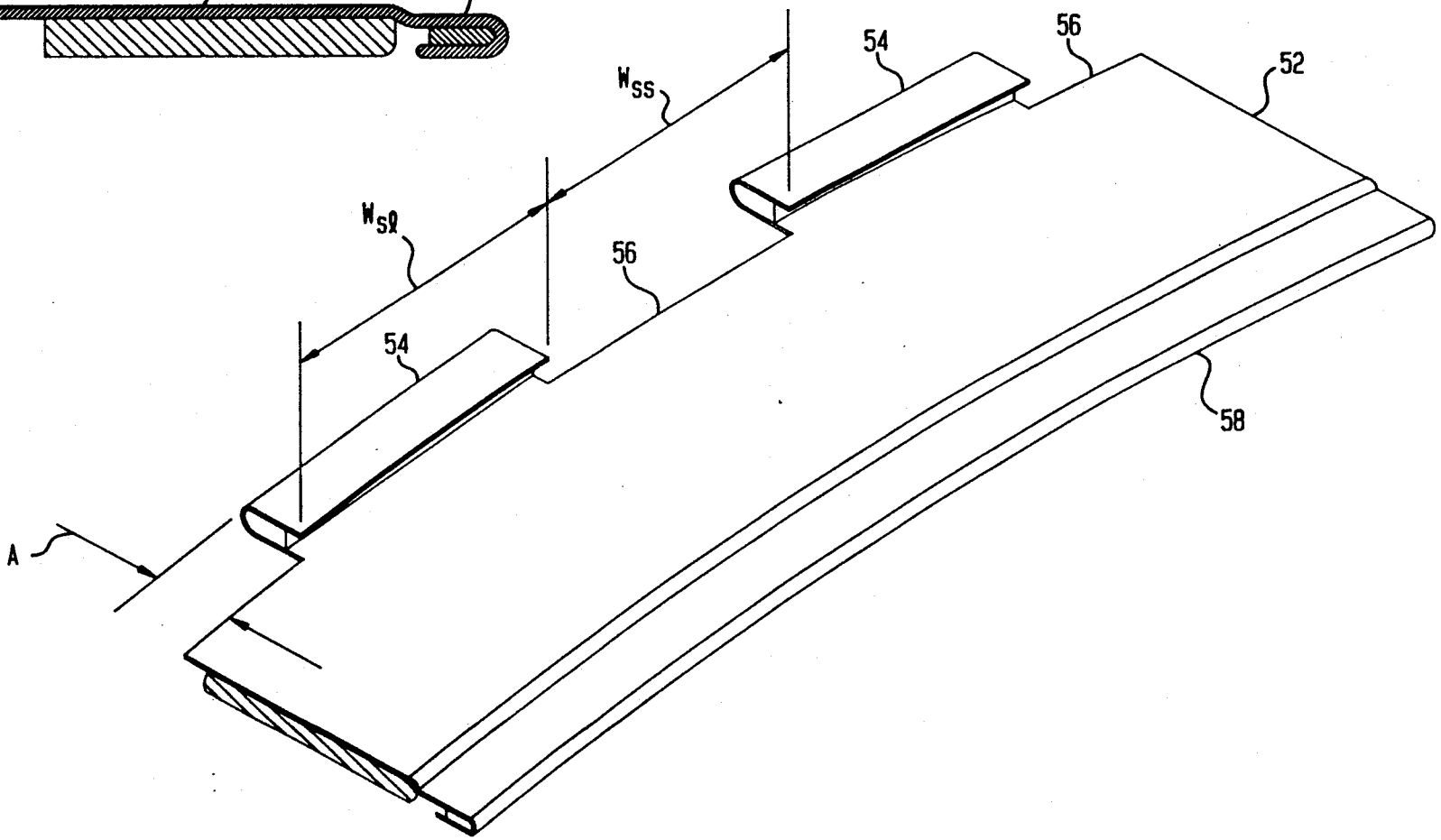
FIG. 7 is an isometric view of the shroud portion illustrated in FIG. 6.
Figure 6:
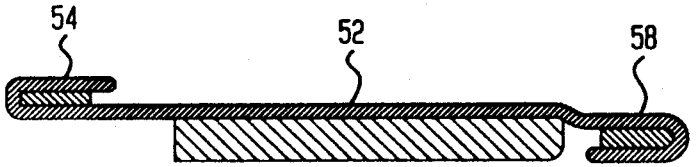
FIG. 6 is an axial sectional view of a portion of the turbine rotor shroud illustrated in FIG. 1.

As shown in FIG. 1, 6, and 7, a shroud 52 in the exemplary form of an arcuate segment is disposed above the sealing tips 24 of the rotor blades 22 to provide a suitable seal therewith in a conventional fashion for reducing leakage of the combustion gases 28 therebetween. The shroud 52 includes a plurality of axially extending shroud lugs 54 at the forward end thereof which are spaced circumferentially apart from each other to define arcuate shroud slots 56 therebetween. The aft end of the shroud 52 includes an axially extending, arcuate aft flange 58. The center portion of the shroud 52 is in the form of a conventional honeycomb seal which is mounted to the casing 12 by the shroud lugs 54 and the aft flange 58 for maintaining a predetermined clearance between the shroud 52 and the rotor blade tips 24 for providing an effective seal therebetween.

Figure 8:
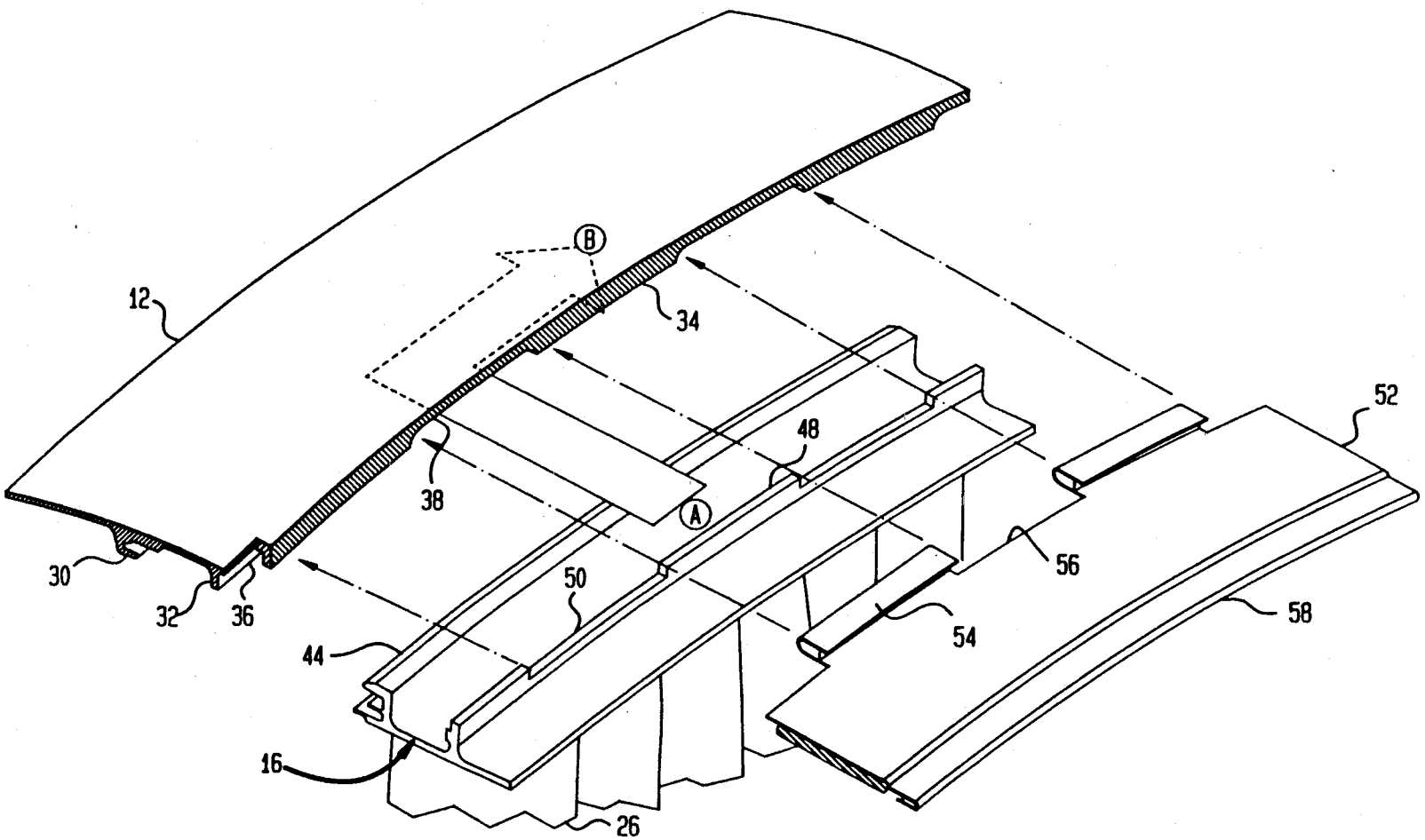
FIG. 8 is an exploded isometric view showing assembly of the stator nozzle segment and shroud to the casing.

More specifically, and referring to FIG. 8, the stator nozzle segment 16 is mounted to the casing 12 in an improved method using the shroud 52 itself for reducing the total number of parts, reducing complexity, and reducing the space requirement needed for the assembly thereof. The stator lugs 48 are sized for translating axially through the respective casing slots 38 as shown along the arrow beginning at position labeled A for passing between adjacent casing lugs 34 into the casing groove 36. In this way, the nozzle segment is solely translated axially without tilting thereof during assembly. FIG. 1 also illustrates in phantom the initial position of the nozzle segment 16 which is translated solely axially to the left without tilting thereof into position as shown in solid line, with the stator forward hook 44 mounted in position on the casing forward hook 30, and the stator aft flange 46 disposed in position under the casing groove 36.

As shown in FIG. 8, the nozzle segment 16 is then rotated clockwise as shown by the dashed arrow labeled B so that the stator lugs 48 are disposed axially between the casing aft flange 32 and the casing lugs 34 in the casing groove 36 and aligned in register circumferentially, or axially, with the casing lugs 34 for axially aligning the stator slots 50 with the respective casing slots 38. This is shown in more particularity in FIG. 9 which then allows each of the shroud lugs 54 to be disposed axially through respective ones of the so aligned casing and stator slots 38 and 50 as shown in FIG. 8. The casing and stator lugs 34 and 48 are axially aligned with each other and disposed in respective ones of the complementary shroud slots 56 for restraining rotation of the stator segment 16 circumferentially around the casing 12 and about the centerline axis 14. In this way dado joints are created by the several lugs and slots which allow solely axial assembly of the nozzle segment 16 and the shroud 52 to the casing 12 without tilting of the nozzle segment 16. The joints also prevent rotation of the nozzle segment 16 about the centerline axis 14 without the need for additional conventional dowels since the shroud 52 itself provides this anti-rotation feature.

Each of the several nozzle segments 16 is first axially inserted through the respective casing slots 38 as described above, and then the complete ring of nozzle segments 16 is rotated into position for aligning the respective stator lugs and slots 48, 50 with the casing lugs and slots 34, 38. The several shrouds 52 are then individually joined thereto with the shroud lugs 54 being axially inserted into the respective, axially aligned casing and stator slots 38, 50, with the shroud slots 56 receiving the respective axially aligned casing and stator lugs 34, 48. Finally, the shroud aft flanges 58 are retained in position by the stator forward hook 44 of the next nozzle stage 16 as illustrated in FIG. 1.

Referring again to FIG. 9, each of the casing slots 38 has a circumferential width $W_{cs}$; each of the stator lugs 48 has a circumferential width $W_{bl}$ which is slightly smaller than the casing slot width $W_{cs}$ by a suitable clearance of about 0.1 mm, for example, for allowing the stator lug 48 to translate axially through the respective casing slot 38 into the casing groove 36. Each of the stator slots 50 has a circumferential width $W_{bs}$, and each of the casing lugs 34 has a circumferential width $W_{cl}$ which is slightly smaller than the stator slot width $W_{bs}$ by a suitable clearance of about 0.1 mm, for example, for allowing the casing lug 34 to pass axially therethrough. The stator slot width $W_{bs}$ is substantially equal to the casing slot width $W_{cs}$ for being axially aligned therewith after the stator lugs 48 are rotated into position. The stator lug width $W_{bl}$ is preferably substantially equal to the casing lug width $W_{cl}$ to provide full contact area between the axially aligned stator lugs 48 and the casing lugs 34 for transmitting axial reaction forces therethrough from the nozzle vanes 26. This also reduces the circumferential clearance between the stator lugs 48 and the shroud lugs 54 to prevent circumferential rotation of the nozzle segment 16 beyond that due to manufacturing tolerances.

Each of the shroud lugs 54 has a circumferential width $W_{sl}$ which is slightly smaller than the widths $W_{cs}$, $W_{bs}$ of the casing and stator slots 38 and 50 for allowing each shroud lug 54 to be axially positioned in respective aligned casing and stator slots 38, 50 for restraining circumferential movement of the nozzle segment 16 upon abutting contact therewith. Each of the shroud slots 56 has a circumferential width $W_{ss}$ which is slightly larger than the casing and stator lug widths $W_{cl}$ and $W_{bl}$ by a suitable clearance of about 0.1 mm, for example, for axially receiving therein the axially aligned casing and stator lugs 34 and 48.

Figure 10:
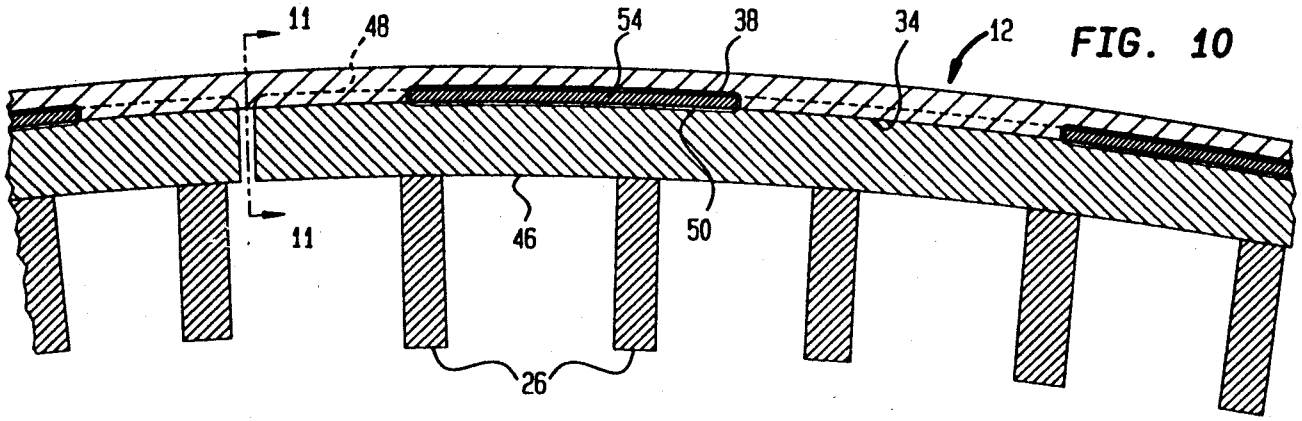
FIG. 10 is a transverse sectional view of a portion of the stator nozzle segment and shroud joined to the casing illustrated in FIG. 1 taken along line 10—10.

Referring also to FIG. 10, once the stator lugs 48 are disposed in the casing groove 36 between the casing aft flange 32 and the casing lugs 34 and axially aligned with the casing lugs 34, the casing and stator slots 38, 50 are also aligned with each other for axially receiving therethrough a respective one of the shroud lugs 54. The width $W_{sl}$ of the shroud lug 54 is preferably slightly smaller than the widths $W_{cs}$ and $W_{bs}$ of the aligned casing slot 38 and the stator slot 50 by a suitable clearance, for example about 0.1 mm, for allowing the shroud lug 54 to be inserted therein in a dado joint manner which will then prevent rotation of the nozzle segment 16 due to abutting contact between the stator lugs 48 and the restraining shroud lugs 54. The shroud lugs 54 are in turn restrained from rotating by their abutting contact with the casing lugs 34.

Figure 9:
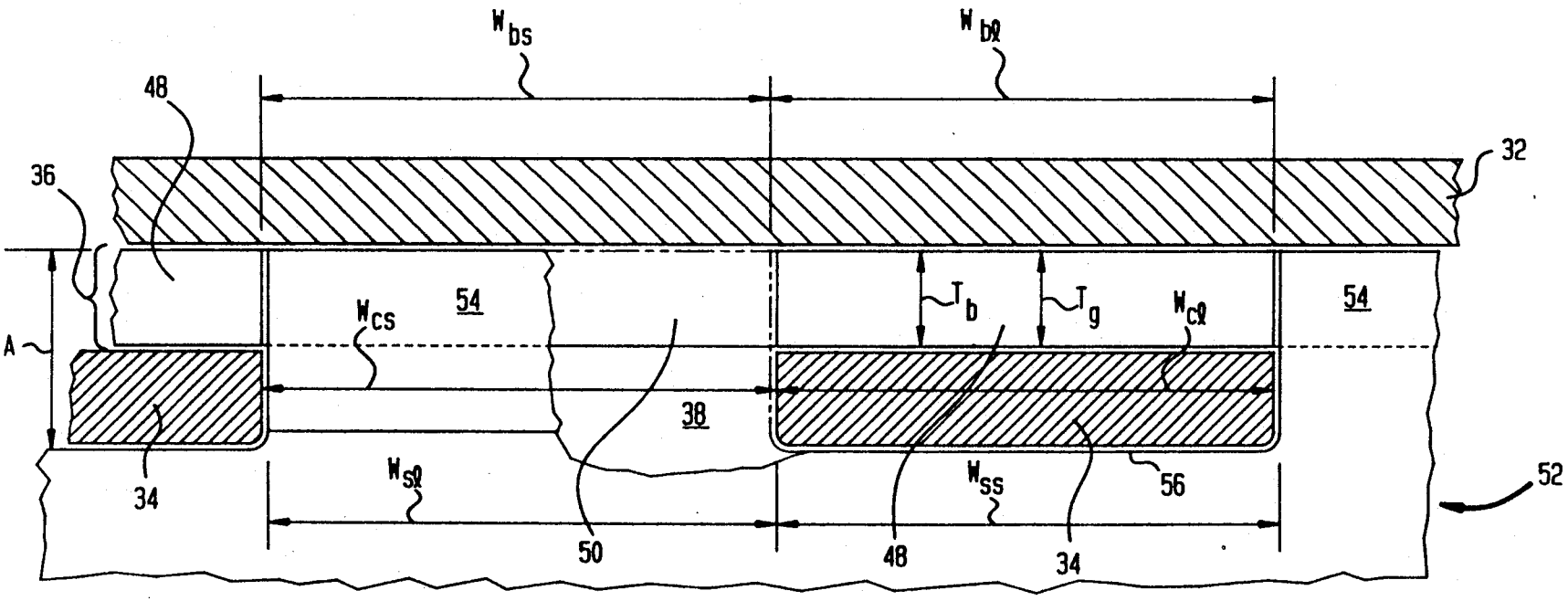
FIG. 9 is a circumferential, partly sectional view through the turbine casing illustrated in FIG. 1 taken along line 9—9.
Figure 11:
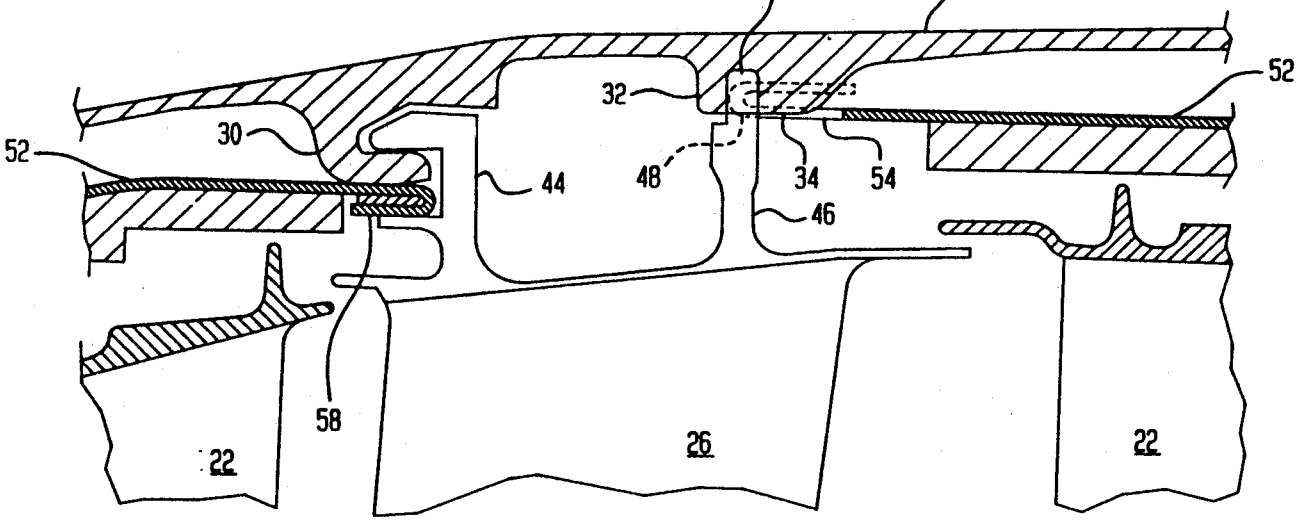
FIG. 11 is an axial, partly sectional view of the stator assembly illustrated in FIG. 10 taken along line 11—11.

As shown in FIG. 9 and 11, the stator lugs 48 are sized to abut the casing lugs 34 for axially restraining the stator segment 16 between the casing forward hook 30 and the casing lugs 34. The casing groove 36 has an axial thickness $T_g$, and each of the stator lugs 48 has an axial thickness $T_b$ which is substantially equal to the casing groove thickness $T_g$ for securing the stator lugs 48 axially between the casing aft flange 32 and the casing lugs 34. In other words, the casing lugs 48 are trapped axially between the casing aft flange 32 and the casing lugs 34. In this way, once the stator lugs 48 are axially inserted through the casing slots 38 and rotated into position within the casing groove 36, the stator forward hook 44 is latched into position on the casing forward hook 30 for axially and radially retaining the stator forward hook 44 to the casing 12 as well as reacting bending moments about the casing forward hook 30. The stator forward hook 44 is sized also for receiving the aft flange 58 of the next upstream shroud 52 for both axial and radial restraint thereof.

As shown in FIG. 9, the shroud lugs 54 have an axial length A and extend through the casing and stator slots 38 and 50 into abutting contact with the casing aft flange 32 for axially restraining movement of the shroud 52 in a forward direction while providing a maximum amount of material of the shroud lug 54 in the casing groove 36 for restraining rotation of the nozzle segment 16 by restraining circumferential movement of the stator lugs 48 thereof.

The respective casing and stator lugs 34 and 48, and their respective slots, provide an effective bayonet-type coupling between the outer band 40 of the nozzle segment 16 and the casing 12 which is locked together by the shroud lugs 54. This provides a relatively simple arrangement with relatively few parts, for example eliminating conventional dowels and/or retention strips, which is easily assembled without requiring tilting of the nozzle segment 16 which, therefore, allows the turbine 10 to be reduced in length for increasing its efficiency.

While there have been described herein what are considered to be preferred embodiments of the present invention, other modifications of the invention shall be apparent to those skilled in the art from the teachings herein, and it is, therefore, desired to be secured in the appended claims all such modifications as fall within the true spirit and scope of the invention.

Accordingly, what is desired to be secured by Letters Patent of the United States is the invention as defined and differentiated in the following claims.

I claim:

1. A gas turbine stator assembly comprising:

an annular casing having an axial centerline axis and including an annular forward hook, an annular aft flange spaced axially from said forward hook, and a plurality of circumferentially aligned casing lugs spaced axially from said aft flange to define an annular casing groove therebetween, said casing lugs being circumferentially spaced apart from each other to define arcuate casing slots therebetween;

a stator nozzle segment having an outer band, an inner band, and a plurality of circumferentially spaced apart vanes extending radially therebetween;

said outer band having a forward hook supported by said casing forward hook, and an aft flange including a plurality of circumferentially spaced apart stator lugs defining therebetween arcuate stator slots, said stator lugs being disposed axially between said casing aft flange and said casing lugs in said casing groove, and aligned axially with respective casing lugs for axially aligning said stator slots with said casing slots; and an arcuate shroud having a plurality of axially extending shroud lugs spaced circumferentially apart from each other to define arcuate shroud slots therebetween, said shroud lugs being disposed axially through both said casing and stator slots, with said casing and stator lugs being disposed in said shroud slots for restraining rotation of said nozzle segment about said centerline axis.

2. An assembly according to claim 1 wherein said stator lugs abut said casing lugs for axially restraining said nozzle segment between said casing forward hook and said casing lugs.

3. An assembly according to claim 2 wherein:

said casing forward hook faces axially aft;

said stator forward hook faces axially forward for being axially translatable into position onto said casing forward hook; and said stator lugs are sized for translating axially through said casing slots into said casing groove.

4. An assembly according to claim 3 wherein:

each of said casing slots has a width;

each of said stator slots has a width substantially equal to said casing slot width; and each of said shroud lugs has a width smaller than said widths of said casing and stator slots for allowing each shroud lug to be axially positioned in respective axially aligned ones of said casing and stator slots for restraining circumferential movement of said nozzle segment upon abutting contact therewith.

5. An assembly according to claim 4 wherein said shroud lugs extend through said casing and stator slots in abutting contact with said casing aft flange.

6. An assembly according to claim 5 wherein:

said casing groove has a thickness; and each of said stator lugs has a thickness substantially equal to said casing groove thickness for securing said stator lugs axially between said casing aft flange and said casing lugs.

7. An assembly according to claim 6 wherein:

each of said casing lugs has a width; and each of said stator lugs has a width substantially equal to said casing lug width.

* * * * *